US011718094B2

(12) United States Patent
Mou et al.

(10) Patent No.: US 11,718,094 B2
(45) **Date of Patent: *Aug. 8, 2023**

(54) WAFER STRUCTURE

(71) Applicant: Microjet Technology Co., Ltd., Hsinchu (TW)

(72) Inventors: Hao-Jan Mou, Hsinchu (TW); Ying-Lun Chang, Hsinchu (TW); Hsien-Chung Tai, Hsinchu (TW); Chi-Feng Huang, Hsinchu (TW); Yung-Lung Han, Hsinchu (TW); Wei-Ming Lee, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/116,340

(22) Filed: Dec. 9, 2020

(65) Prior Publication Data

US 2022/0134748 A1 May 5, 2022

(30) Foreign Application Priority Data

Nov. 3, 2020 (TW) ..... 109138193

(51) Int. Cl.
*B41J 2/14* (2006.01)
*B41J 2/16* (2006.01)

(52) U.S. Cl.
CPC ..... *B41J 2/14024* (2013.01); *B41J 2/14072* (2013.01); *B41J 2/14129* (2013.01); *B41J 2/1601* (2013.01); *B41J 2/1635* (2013.01); *B41J 2202/11* (2013.01); *B41J 2202/13* (2013.01)

(58) Field of Classification Search
CPC ..... B41J 2/14024; B41J 2/14129; B41J 2/14072; B41J 2202/11; B41J 2202/13; B41J 2/1635; B41J 2/1601; H01L 49/00
See application file for complete search history.

(56) References Cited

U.S. PATENT DOCUMENTS 6,902,256 B2 * 6/2005 Anderson ..... B41J 2/14129 347/56
7,090,340 B2 * 8/2006 Tobita ..... B41J 2/14274 347/65
8,430,482 B2 * 4/2013 Fang ..... B41J 2/1601 347/49
9,016,836 B2 * 4/2015 Kunnavakkam ..... B41J 2/14129 347/61
9,776,402 B2 * 10/2017 White ..... B41J 2/3354

FOREIGN PATENT DOCUMENTS

TW 200707526 A 2/2007
TW 201413836 A 4/2014
TW 201827244 A 8/2018

* cited by examiner

*Primary Examiner* — Geoffrey S Mruk
(74) *Attorney, Agent, or Firm* — Birch, Stewart, Kolasch & Birch, LLP

(57) ABSTRACT

A wafer structure is disclosed and includes a chip substrate and at least one inkjet chip. The chip substrate is a silicon substrate which is fabricated by a semiconductor process on a wafer of at least 12 inches. The at least one inkjet chip is directly formed on the chip substrate by the semiconductor process, and the wafer is diced into the at least one inkjet chip, to be implemented for inkjet printing.

20 Claims, 9 Drawing Sheets

WAFER STRUCTURE

FIELD OF THE INVENTION

The present disclosure relates to a wafer structure, and more particularly to a wafer structure fabricated by a semiconductor process and applied to an inkjet chip for inkjet printing.

BACKGROUND OF THE INVENTION

In view of the common printers currently on the market, in addition to a laser printer, an inkjet printer is another model widely used. The inkjet printer has the advantages of low price, easy operation and low noise. Moreover, the inkjet printer is capable of printing on various printing media, such as paper and photo paper. The printing quality of an inkjet printer mainly depends on the design factors of an ink cartridge. In particular, the design factor of an inkjet chip releasing ink droplets to the printing medium is regarded as an important consideration in the design factors of the ink cartridge.

In addition, as the inkjet chip is pursuing the printing quality requirements of higher resolution and higher printing speed, the price of the inkjet printer has dropped very fast in the highly competitive inkjet printing market. Therefore, the manufacturing cost of the inkjet chip combined with the ink cartridge and the design cost of higher resolution and higher printing speed are key factors that determine market competitiveness.

However, the inkjet chip produced in the current inkjet printing market is made from a wafer structure by a semiconductor process. The conventional inkjet chip is all fabricated with the wafer structure of less than 6 inches. Moreover, in the pursuit of higher resolution and higher printing speed at the same time, the design of the printing swath of the inkjet chip needs to be changed to be larger and longer, so that the printing speed can be greatly increased. In this way, the overall area required for the inkjet chip is larger. Therefore, the number of inkjet chips required to be manufactured on a wafer structure with a limited area of less than 6 inches is quite limited, and the manufacturing cost cannot be effectively reduced.

For example, the printing swath of an inkjet chip produced from a wafer structure of less than 6 inches is 0.56 inches, and can be diced to generate 334 inkjet chips at most. Furthermore, the wafer structure of less than 6 inches is utilized to produce the inkjet chip having the printing swath more than 1 inch or meeting the printing swath of one A4 page width (8.3 inches), so that the printing quality requirements of higher resolution and higher printing speed is achieved. Under the printing quality requirements, the number of inkjet chips required to be produced on the wafer structure with the limited area less than 6 inches is quite limited, and the number is even smaller. If the inkjet chips are produced on the wafer structure with the limited area of less than 6 inches, there is a waste of remaining blank area. These empty areas occupy more than 20% of the entire area of the wafer structure, and it is quite wasteful. Furthermore, the manufacturing cost cannot be effectively reduced.

Therefore, how to meet the pursuit of lower manufacturing cost of the inkjet chip in the inkjet printing market and the printing quality pursuit of higher resolution and higher printing speed is a main subject developed in the present disclosure.

SUMMARY OF THE INVENTION

An object of the present disclosure provides a wafer structure including a chip substrate and a plurality of inkjet chips. The chip substrate is fabricated by a semiconductor process on a wafer of at least 12 inches or more, so that more inkjet chips required are arranged on the chip substrate, and arranged in a printing inkjet design for higher resolution and higher performance. On the other hand, the inkjet chips having different sizes in response to different printing swath are required, and the inkjet chips on the chip substrate are diced according to the requirements and the applications. It is helpful of reducing the restriction of the chip substrate for the inkjet chips, and reducing the unused area on the chip substrate. Consequently, the utilization of the chip substrate is improved, the vacancy rate of the chip substrate is reduced, and the manufacturing cost is reduced. At the same time, the printing quality pursuit of higher resolution and higher printing speed is achieved.

In accordance with an aspect of the present disclosure, a wafer structure is provided and includes a chip substrate and at least one inkjet chip. The chip substrate is a silicon substrate and fabricated by a semiconductor process on a wafer of at least 12 inches. The at least one inkjet chip is directly formed on the chip substrate by the semiconductor process, whereby the wafer is diced into the at least one inkjet chip, to be implemented for inkjet printing.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
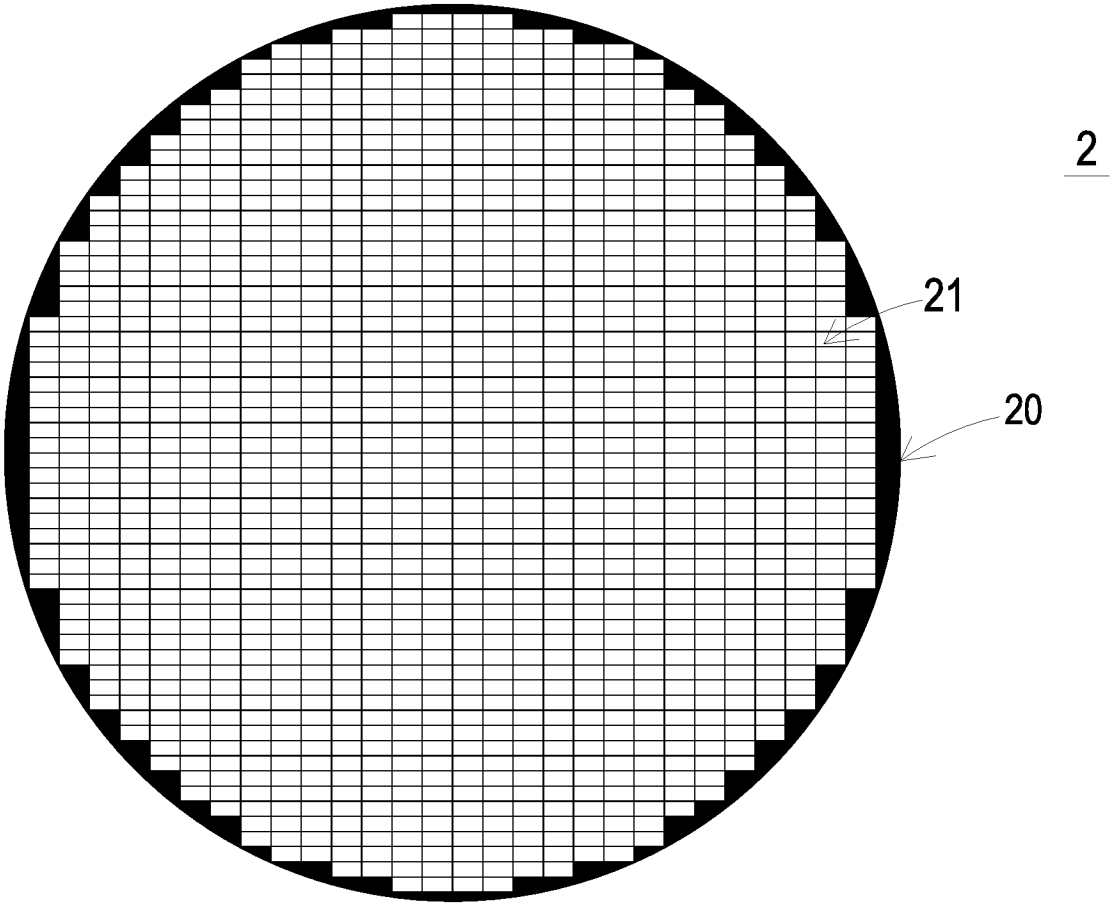
FIG. 1 is a schematic view illustrating a wafer structure according to an embodiment of the present disclosure.
Figure 2:
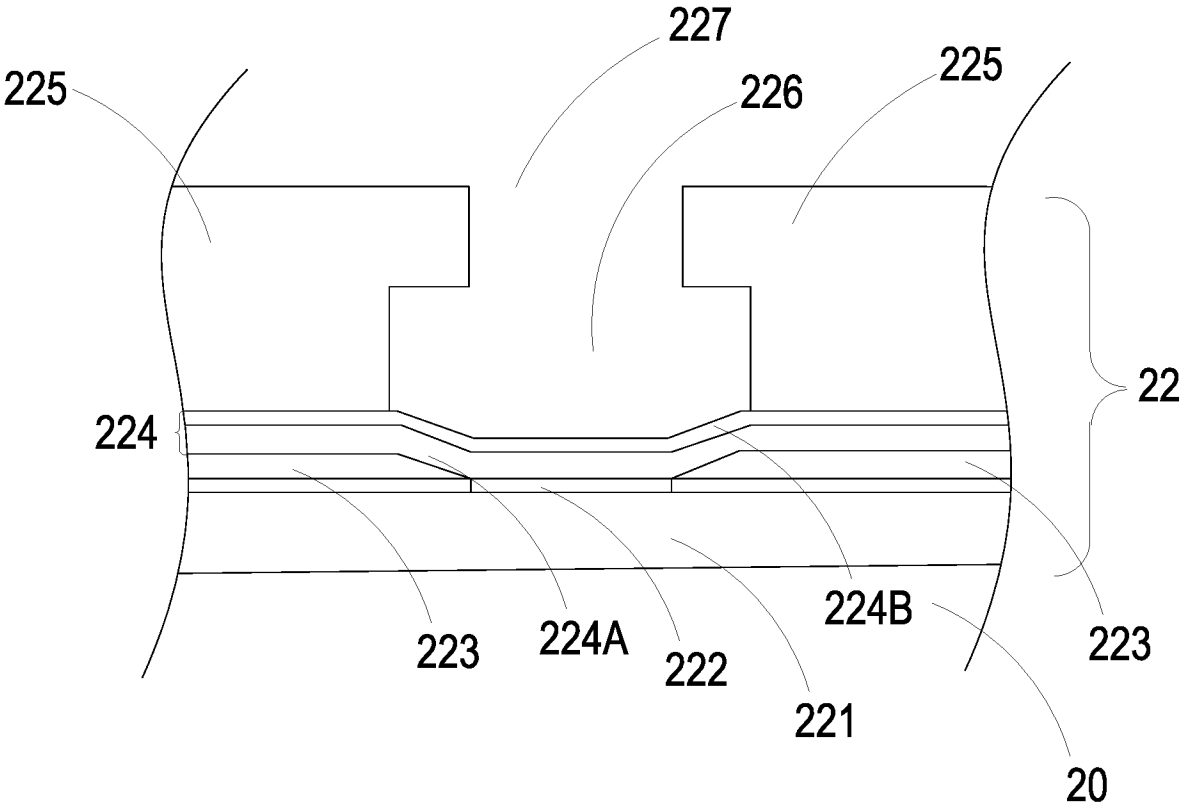
FIG. 2 is a schematic cross-sectional view illustrating the ink-drop generators on the wafer structure according to the embodiment of the present disclosure.

Please refer to FIG. 1 and FIG. 2. The present disclosure provides a wafer structure 2. The wafer structure 2 includes a chip substrate 20 and a plurality of inkjet chips 21. Preferably but not exclusively, the chip substrate 20 is a silicon substrate and fabricated by a semiconductor process on a wafer of at least 12 inches. In an embodiment, the chip substrate 20 is fabricated by the semiconductor process on a 12-inch wafer. In another embodiment, the chip substrate 20 is fabricated by the semiconductor process on a 16-inch wafer.

In the embodiment, each of the inkjet chips 21 includes a plurality of ink-drop generators 22, respectively. The plurality of ink-drop generators 22 are produced by the semiconductor process and formed on the chip substrate 20. Moreover, the plurality of inkjet chips 21 on the chip substrate 20 are diced into at least one inkjet chips. As shown in FIG. 2, each of the ink-drop generators 22 includes a thermal-barrier layer 221, a resistance heating layer 222, a conductive layer 223, a protective layer 224, a barrier layer 225, an ink-supply chamber 226 and a nozzle 227. In the embodiment, the thermal-barrier layer 221 is formed on the chip substrate 20. The resistance heating layer 222 is formed on the thermal-barrier layer 221. The conductive layer 223 and a part of the protective layer 224 are formed on the resistance heating layer 222. A rest part of the protective layer 224 is formed on the conductive layer 223. The barrier layer 225 is formed on the protective layer 224. Moreover, the ink-supply chamber 226 and the nozzle 227 are integrally formed in the barrier layer 225. In the embodiment, a bottom of the ink-supply chamber 226 is in communication with the protective layer 224. A top of the ink-supply chamber 226 is in communication with the nozzle 227. In other words, the ink-drop generator 22 of the inkjet chip 21 is fabricated by implementing the semiconductor process on the chip substrate 20, and it is described as the followings. Firstly, a thin film of the thermal-barrier layer 221 is formed on the chip substrate 20. Secondly, the heating resistance layer 222 and the conductive layer 223 are successively disposed thereon by sputtering, and the required size is determined by the process of photolithography. Afterwards, the protective layer 224 is coated thereon through a sputtering device or a chemical vapor deposition (CVD) device. Then, the ink-supply chamber 226 is formed on the protective layer 224 by dry film lamination, and a dry film is coated to form the nozzle 227 by dry film lamination, so that the barrier layer 225 is integrally formed on the protective layer 224. In this way, the ink-supply chamber 226 and the nozzle 227 are integrally formed in the barrier layer 225. Alternatively, in another embodiment, a polymer film is formed on the protective layer 224 to directly define the ink-supply chamber 226 and the nozzle 227 by a photolithography process. In this way, the ink-supply chamber 226 and the nozzle 227 are integrally formed in the barrier layer 225. The bottom of the ink-supply chamber 226 is in communication with the protective layer 224, and the top of the ink-supply chamber 226 is in communication with the nozzle 227. In the embodiment, the chip substrate 20 is a silicon substrate. The thermal-barrier layer 221 is made of a silicon dioxide ($SiO_2$) material. The resistance heating layer 222 is made of a tantalum aluminide (TaAl) material. The conductive layer 223 is made of an aluminum (Al) material. The protective layer 224 is formed by stacking a second protective layer 224B disposed above on a first protective layer 224A disposed below. The first protective layer 224A is made of a silicon nitride ($Si_3N_4$) material. The second protective layer 224B is made of a silicon carbide (SiC) material. The barrier layer 225 is made of a polymer material.

Figure 3A:
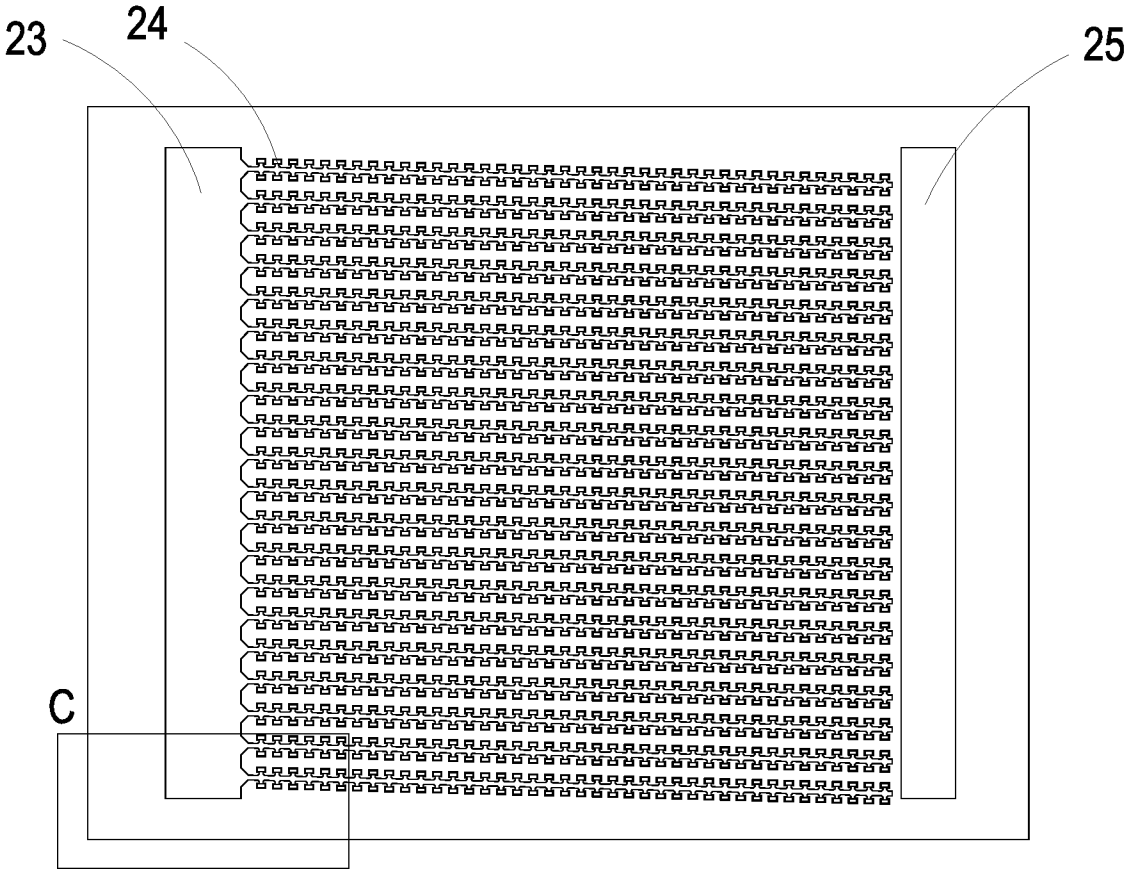
FIG. 3A is a schematic view illustrating the ink-supply channels, the manifolds and the ink-supply chamber arranged on the inkjet chip of the wafer structure according to the embodiment of the present disclosure.
Figure 3B:
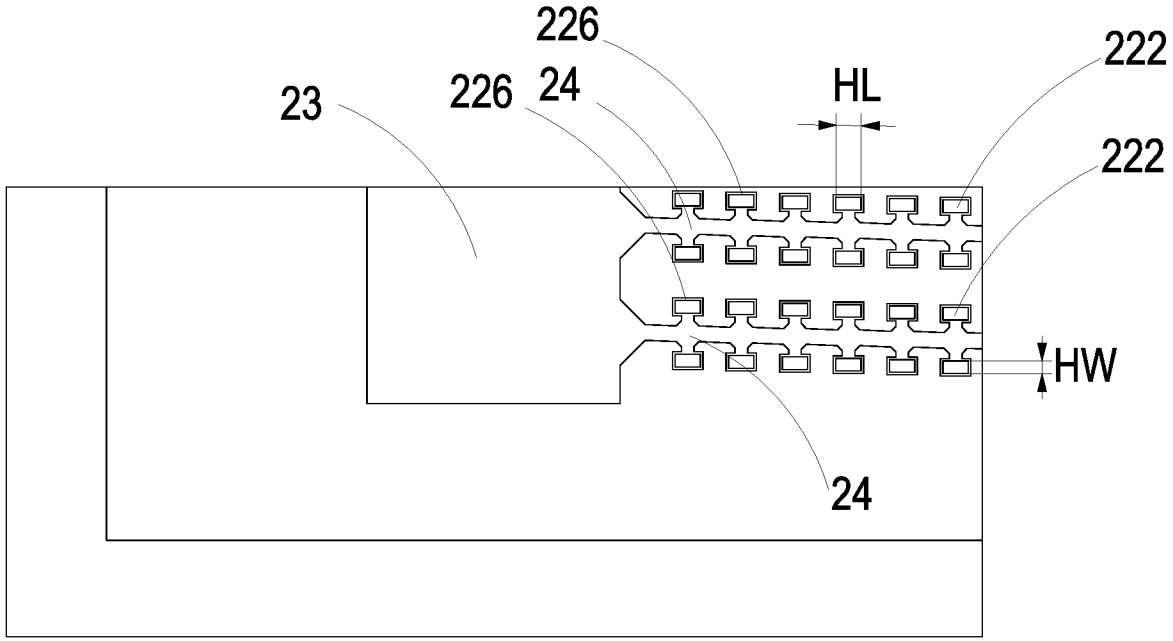
FIG. 3B is a partial enlarged view illustrating the region C of FIG. 3A.

Certainly, in the embodiment, the ink-drop generator 22 of the inkjet chip 21 is fabricated by implementing the semiconductor process on the wafer substrate 20. Further in the process of determining the required size by the lithographic etching process, as shown in FIGS. 3A to 3B, at least one ink-supply channel 23 and a plurality of manifolds 24 are defined. Then, the ink-supply chamber 226 is formed on the protective layer 224 by dry film lamination, and a dry film is coated to form the nozzle 227 by dry film lamination, so that the barrier layer 225 is integrally formed on the protective layer 224 as shown in FIG. 2. Moreover, the ink-supply chamber 226 and the nozzle 227 are integrally formed in the barrier layer 225. In the embodiment, the bottom of the ink-supply chamber 226 is in communication with the protective layer 224, and the top of the ink-supply chamber 226 is in communication with the nozzle 227. The plurality of nozzles 227 are directly exposed on the surface of the inkjet chip 21 and disposed in the required arrangement, as shown in FIG. 3D. Therefore, the ink-supply channels 23 and the plurality of manifolds 24 are also fabricated by the semiconductor process at the same time. Each of the plurality of ink-supply channels 23 provides ink, and the ink-supply channel 23 is in communication with the plurality of manifolds 24. Moreover, the plurality of manifolds 24 are in communication with each of the ink-supply chambers 226 of the ink-drop generators 22. As shown in FIG. 3B, the resistance heating layer 222 is formed and exposed in the ink-supply chamber 226. The heating resistor layer 222 has a rectangular area formed by a length HL and a width HW.

Figure 3C:
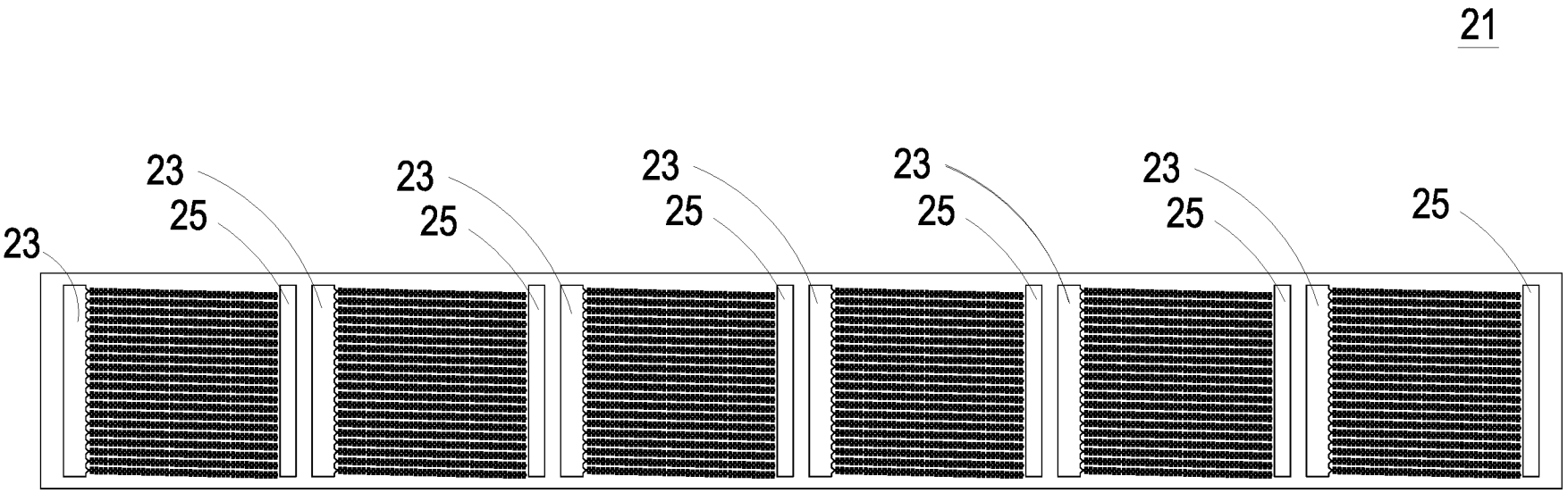
FIG. 3C is a schematic view illustrating the ink-supply channels and the inkjet control circuit zone arranged on the inkjet chip of the wafer structure according to another embodiment of the present disclosure.
Figure 3D:
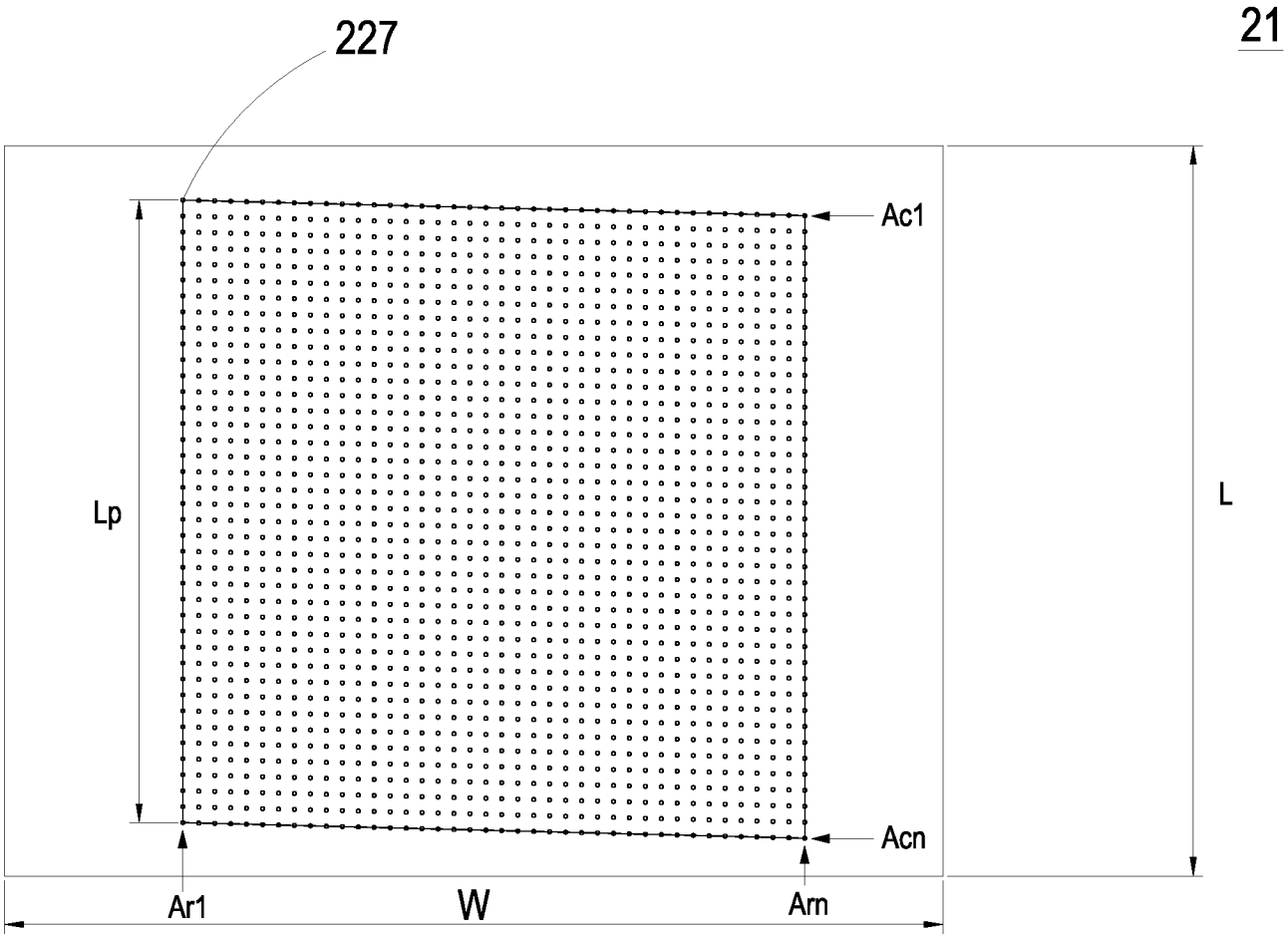
FIG. 3D is a schematic view illustrating the nozzles formed and arranged on the inkjet chip of FIG. 3A.

Please refer to FIGS. 3A and 3C. The number of the at least one ink-supply channel 23 is one to six. As shown in FIG. 3A, the number of the at least one ink-supply channel 23 arranged on a single inkjet chip 21 is one, thereby providing monochrome ink. Preferably but not exclusively, the monochrome ink is one selected from the group consisting of cyan, magenta, yellow and black ink. As shown in FIG. 3C, the number of the at least one ink-supply channel 23 arranged on a single inkjet chip 21 is six, thereby providing six-color ink of black, cyan, magenta, yellow, light cyan and light magenta, respectively. Certainly, in other embodiments, the number of the at least one ink-supply channel 23 arranged on a single inkjet chip 21 is four, thereby providing four-color ink of cyan, magenta, yellow and black, respectively. The number of the ink-supply channels 23 is adjustable and designed according to the practical requirements.

Figure 4:
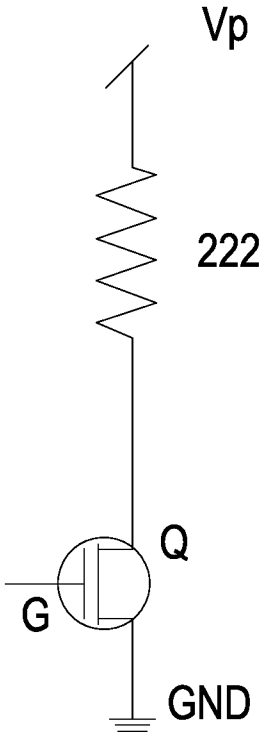
FIG. 4 is a schematic circuit diagram illustrating the resistance heating layer controlled and excited by the conductive layer for heating according to the embodiment of the present disclosure.

Please refer to FIG. 3A, FIG. 3C and FIG. 4. In the embodiment, the conductive layer 223 is fabricated by implementing the semiconductor process on the wafer structure 2. Preferably but not exclusively, the conductive layer 223 is connected to a conductor fabricated by the semiconductor process of less than 90 nanometers to form an inkjet control circuit. In that, more metal oxide semiconductor field-effect transistors (MOSFETs) are arranged in the inkjet control circuit zone 25 to control the resistance heating layer 222. Thereby, a loop is formed on the resistance heating layer 222 to activate heating. Alternatively, the loop is not formed on the resistance heating layer 222, and the resistance heating layer 222 is not activated for heating. That is, as shown in FIG. 4, when a voltage Vp is applied to the resistance heating layer 222, the transistor switch Q controls the circuit state of the resistance heating layer 222 grounded. When one end of the resistance heating layer 222 is grounded, a loop is formed to activate heating. Alternatively, if the loop is not formed, the resistance heating layer 22 is not grounded and not activated for heating. Preferably but not exclusively, the transistor switch Q is a metal oxide semiconductor field effect transistor (MOSFET), and the conductor connected to the conductive layer 223 is a gate G of the metal oxide semiconductor field effect transistor (MOSFET). In an embodiment, the conductive layer 223 is connected to a conductor, and the conductor is a gate G of a complementary metal oxide semiconductor (CMOS). In another embodiment, the conductive layer 223 is connected to a conductor, and the conductor is a gate G of an N-type metal oxide semiconductor (NMOS). The conductor connected to the conductive layer 223 is adjustable and selected according to the practical requirements for the inkjet control circuit. Certainly, in an embodiment, the conductor connected to the conductive layer 223 is fabricated by the semiconductor process of 65 nanometers to 90 nanometers, to form the inkjet control circuit. In an embodiment, the conductor connected to the conductive layer 223 is fabricated by the semiconductor process of 45 nanometers to 65 nanometers, to form the inkjet control circuit. In an embodiment, the conductor connected to the conductive layer 223 is fabricated by the semiconductor process of 28 nanometers to 45 nanometers, to form the inkjet control circuit. In an embodiment, the conductor connected to the conductive layer 223 is fabricated by the semiconductor process of 20 nanometers to 28 nanometers, to form the inkjet control circuit. In an embodiment, the conductor connected to the conductive layer 223 is fabricated by the semiconductor process of 12 nanometers to 20 nanometers, to form the inkjet control circuit. In an embodiment, the conductor connected to the conductive layer 223 is fabricated by the semiconductor process of 7 nanometers to 12 nanometers, to form the inkjet control circuit. In an embodiment, the conductor connected to the conductive layer 223 is fabricated by the semiconductor process of 2 nanometers to 7 nanometers, to form the inkjet control circuit. It is understandable that the more sophisticated the semiconductor process technology, the more groups of inkjet control circuits can be fabricated with the same unit volume.

As described above, the present disclosure provides the wafer structure 2 including the chip substrate 20 and the plurality of inkjet chips 21. The chip substrate 20 is fabricated by the semiconductor process on a wafer of at least 12 inches or more, so that a larger number of inkjet chips 21 required are arranged on the chip substrate 20. The restriction of the chip substrate 20 for the inkjet chips 21 is reduced. Moreover, the unused area on the chip substrate 20 is reduced. Consequently, the utilization of the chip substrate 20 is improved, the vacancy rate of the chip substrate 20 is reduced, and the manufacturing cost is reduced. At the same time, the printing quality pursuit of higher resolution and higher printing speed is achieved.

The resolution and the sizes of printing swath of the inkjet chip 21 are described below.

Figure 5:
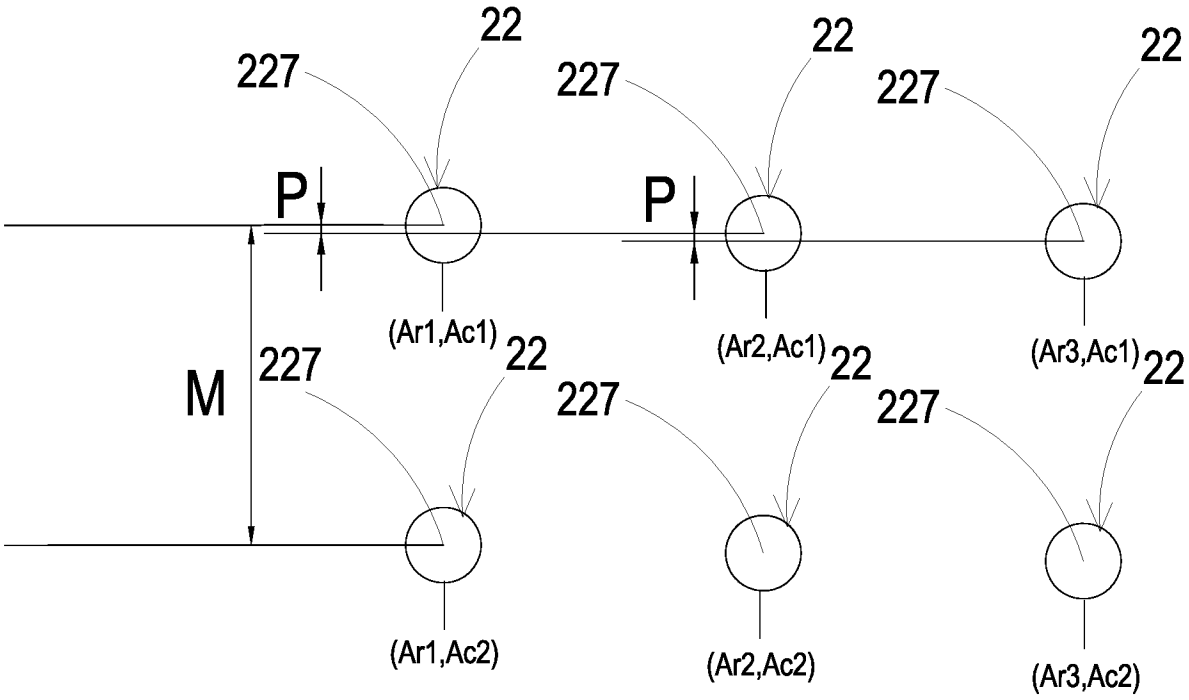
FIG. 5 is an enlarged view illustrating the ink-drop generators formed and arranged on the wafer structure according to the embodiment of the present disclosure.

As shown in FIGS. 3D and 5, each of the inkjet chips 21 includes a rectangular area having a length L and a width W, and a printing swath Lp. In the embodiment, each of inkjet chips 21 includes a plurality of ink-drop generators 22 produced by the semiconductor process and formed on the chip substrate 20. In the inkjet chips 21, the plurality of ink-drop generators 22 are arranged in the longitudinal direction to form a plurality of longitudinal axis array groups (Ar1 . . . Arn) having a pitch M maintained between two adjacent ink-drop generators 22 in the longitudinal direction, and arranged in the horizontal direction to form a plurality of horizontal axis array groups (Ac1 . . . Acn) having a central stepped pitch P maintained between two adjacent ink-drop generators 22 in the horizontal direction. That is, as shown in FIG. 5, the pitch M is maintained between the ink-drop generator 22 with the coordinate (Ar1, Ac1) and the ink-drop generator 22 with the coordinate (Ar1, Ac2). Moreover, the central stepped pitch P is maintained between the ink-drop generator 22 with the coordinate (Ar1, Ac1) and the ink-drop generator 22 with the coordinate (Ar2, Ac1). The resolution number of dots per inch (DPI) for the inkjet chip 21 is equal to 1/(the central stepped pitch P). Therefore, in order to achieve the higher resolution required, a layout design with a resolution of at least 600 DPI is utilized in the present disclosure. Namely, the central stepped pitch P is at least equal to $1/600$ inches or less. Certainly, the resolution DPI of the inkjet chip 21 in the present disclosure can also be designed with at least 600 DPI to 1200 DPI. That is the central stepped pitch P is equal to at least $1/600$ inches to $1/1200$ inches. Preferably but not exclusively, the resolution DPI of the inkjet chip 21 is designed with 720 DPI, and the central stepped pitch P is at least equal to $1/720$ inches or less. Preferably but not exclusively, the resolution DPI of the inkjet chip 21 in the present disclosure is designed with at least 1200 DPI to 2400 DPI. That is, the central stepped pitch P is equal to at least $1/1200$ inches to $1/2400$ inches. Preferably but not exclusively, the resolution DPI of the inkjet chip 21 in the present disclosure is designed with at least 2400 DPI to 24000 DPI. That is, the central stepped pitch P is equal to at least $1/2400$ inches to $1/24000$ inches. Preferably but not exclusively, the resolution DPI of the inkjet chip 21 in the present disclosure is designed with at least 24000 DPI to 48000 DPI. That is, the central stepped pitch P is equal to at least $1/24000$ inches to $1/48000$ inches.

In the embodiment, the inkjet chip 21 disposed on the wafer structure 2 has a printing swath Lp, which is more than 0.25 inches. Preferably but not exclusively, the printing swath Lp of the inkjet chip 21 ranges from at least 0.25 inches to 0.5 inches. Preferably but not exclusively, the printing swath Lp of the inkjet chip 21 ranges from at least 0.5 inches to 0.75 inches. Preferably but not exclusively, the printing swath Lp of the inkjet chip 21 ranges from at least 0.75 inches to 1 inch. Preferably but not exclusively, the printing swath Lp of the inkjet chip 21 ranges from at least 1 inch to 1.25 inches. Preferably but not exclusively, the printing swath Lp of the inkjet chip 21 ranges from at least 1.25 inches to 1.5 inches. Preferably but not exclusively, the printing swath Lp of the inkjet chip 21 ranges from at least 1.5 inches to 2 inches. Preferably but not exclusively, the printing swath Lp of the inkjet chip 21 ranges from at least 2 inches to 4 inches. Preferably but not exclusively, the printing swath Lp of the inkjet chip 21 ranges from at least 4 inches to 6 inches. Preferably but not exclusively, the printing swath Lp of the inkjet chip 21 ranges from at least 6 inches to 8 inches. Preferably but not exclusively, the printing swath Lp of the inkjet chip 21 ranges from at least 8 inches to 12 inches. Preferably but not exclusively, the printing swath Lp of the inkjet chip 21 is 8.3 inches, and 8.3 inches is the page width of the A4-size paper, so that the inkjet chip 21 is provided with the page width print function on the A4-size paper. Preferably but not exclusively, the printing swath Lp of the inkjet chip 21 is 11.7 inches, and 11.7 inches is the page width of the A3-size paper, so that the inkjet chip 21 is provided with the page width print function on the A3-size paper. Preferably but not exclusively, the printing swath Lp of the inkjet chip 21 is greater than at least 12 inches. In the embodiment, the inkjet chip 21 disposed on the wafer structure 2 has a width W, which ranges from at least 0.5 mm to 10 mm. Preferably but not exclusively, the width W of the inkjet chip 21 ranges from at least 0.5 mm to 4 mm. Preferably but not exclusively, the width W of the inkjet chip 21 ranges from at least 4 mm to 10 mm.

Figure 6:
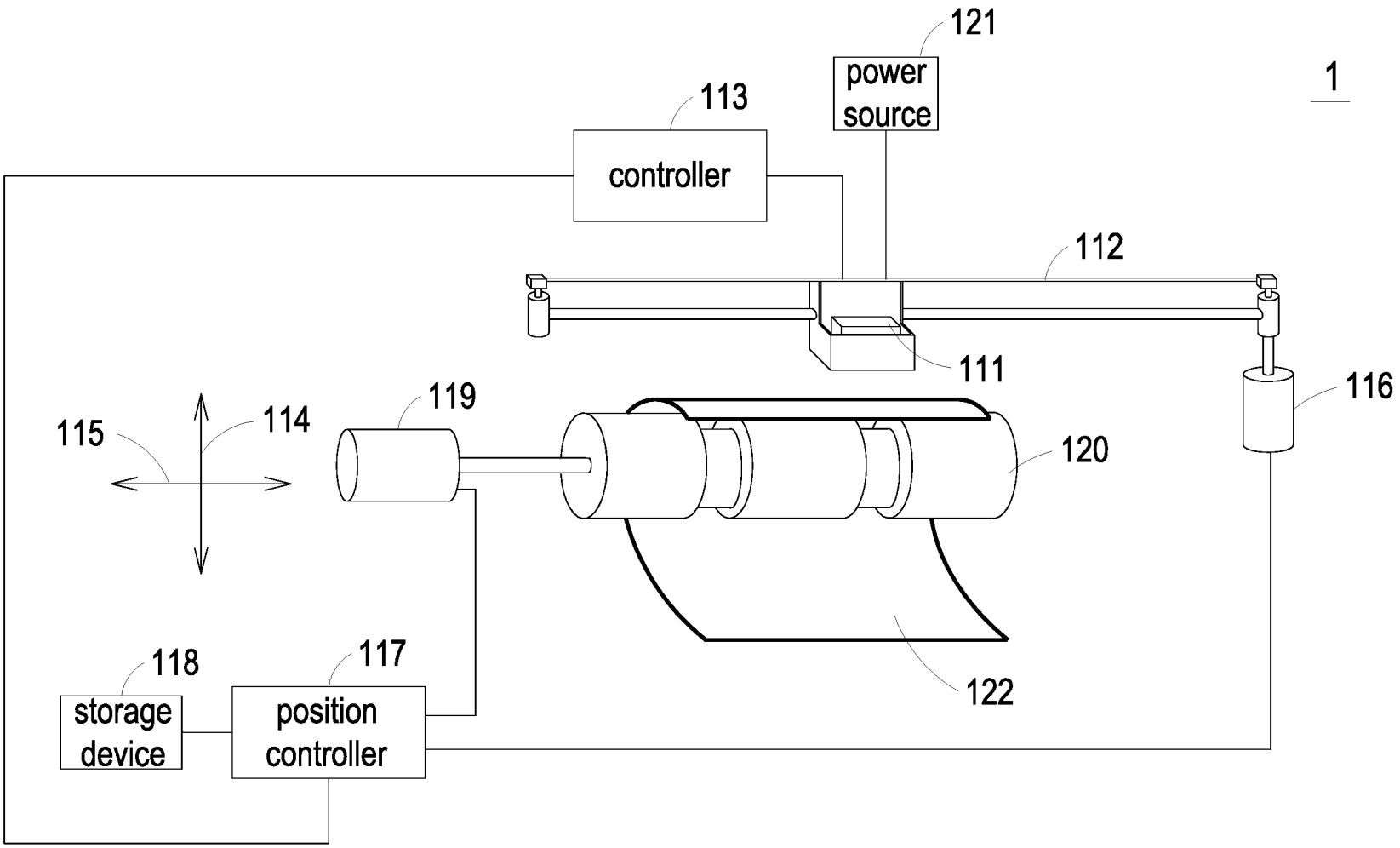
FIG. 6 is a schematic view illustrating an internal carrying system applied to an inkjet printer.

In the present disclosure, the wafer structure 2 is provided and includes the chip substrate 20 and the plurality of inkjet chips 21. The chip substrate 20 is fabricated by the semiconductor process on a wafer of at least 12 inches or more, so that a larger number of inkjet chips 21 required are arranged on the chip substrate 20. Therefore, the plurality of inkjet chips 21 diced from the wafer structure 2 of the present disclosure can be implemented for inkjet printing of a printhead 111. The following is an explanation. Please refer to FIG. 6. In the embodiment, the carrying system 1 is mainly used to support the structure of the printhead 111 in the present disclosure. The carrying system 1 includes a carrying frame 112, a controller 113, a first driving motor 116, a position controller 117, a second driving motor 119, a paper feeding structure 120 and a power source 121. The power source 121 provides electric energy for operation of the entire carrying system 1. In the embodiment, carrying frame 112 is mainly used to accommodate the print head 111 and includes one end connected with the first driving motor 116, so as to drive the printhead 111 to move along a linear track in the direction of a scanning axis 115. Preferably but not exclusively, the printhead 111 is detachably or permanently installed on the carrying frame 112. The controller 113 is connected to the carrying frame 112 to transmit a control signal to the printhead 111. Preferably but not exclusively, in the embodiment, the first driving motor 116 is a stepping motor. The first driving motor 116 is configured to move the carrying frame 112 along the scanning axis 115 according to a control signal sent by the position controller 117, and the position controller 117 determines the position of the carrying frame 112 on the scanning axis 115 through a storage device 118. In addition, the position controller 117 is also configured to control the operation of the second driving motor 119 to drive the printing medium 122, such as paper, and the paper feeding structure 120. In that, the printing medium 122 is moved along the direction of a feeding axis 114. After the printing medium 122 is positioned in the printing area (not shown), the first drive motor 116 is driven by the position controller 117 to move the carrying frame 112 and the printhead 111 along the scanning axis 115 for printing on the printing medium 122. After one or more scanning is performed along the scanning axis 115, the position controller 117 controls the second driving motor 119 to operate and drive the printing medium 122 and the paper feeding structure 120. In that, the printing medium 122 is moved along the feeding axis 114 to place another area of the printing medium 122 into the printing area. Then, the first drive motor 116 drives the carrying frame 112 and the printhead 111 to move along the scanning axis 115 for performing another line of printing on the printing medium 112. When all the printing data is printed on the printing medium 122, the printing medium 122 is pushed out to an output tray (not shown) of the inkjet printer. Thus, the printing action is completed.

From the above descriptions, the present disclosure provides a wafer structure including a chip substrate and a plurality of inkjet chips. The chip substrate is fabricated by a semiconductor process on a wafer of at least 12 inches or more, so that more inkjet chips required are arranged on the chip substrate. In addition, it prevents from limiting the size of the inkjet chips due to the insufficient size of the chip substrate. The wafer greater than 12 inches is utilized, and the use area of the chip substrate is improved. The vacancy rate is reduced, and the waste material on the wafer is reduced. While the waste material is reduced, the semiconductor waste is also reduced to achieve the effect of environmental protection. At the same time, the printing quality pursuit of higher resolution and higher printing speed is achieved. The present disclosure includes the industrial applicability and the inventive steps.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wafer structure, comprising:

a chip substrate being a silicon substrate and fabricated by a semiconductor process on a wafer of at least 12 inches; and at least one inkjet chip directly formed on the chip substrate, wherein the wafer is diced into the at least one inkjet chip, to be implemented for inkjet printing, wherein the at least one inkjet chip comprises:

at least one ink-supply channel configured to provide ink; and a plurality of ink-drop generators respectively connected to the at least one ink-supply channel, wherein each of the ink-drop generators comprises a thermal-barrier layer, a resistance heating layer, a conductive layer, a protective layer, a barrier layer, an ink-supply chamber and a nozzle, wherein the thermal-barrier layer is directly disposed on a surface of the chip substrate, the resistance heating layer is directly disposed on a surface of the thermal-barrier layer, the conductive layer and a part of the protective layer are formed on the resistance heating layer, a rest part of the protective layer is formed on the conductive layer, wherein the barrier layer is directly formed on the protective layer, and the ink-supply chamber and the nozzle are integrally formed in the barrier layer, wherein a step difference is formed between the conductive layer and the resistance heating layer, and the conductive layer is misaligned with the resistance heating layer, wherein the barrier layer includes two opposite inner sidewalls defining two opposite sides of the ink-supply chamber, each of the two opposite inner sidewalls of the barrier layer continuously extends from a respective one of two opposite sides of a top surface of a continuous portion of the protective layer toward the nozzle, the two opposite inner sidewalls of the barrier layer entirely and directly overlap with the conductive layer in a direction normal to a bottom of the ink-supply chamber, and the top surface of the continuous portion of the protective layer is the bottom of the ink-supply chamber, and wherein an ink supply path is formed between the at least one ink-supply channel and the ink-supply chamber of each of the plurality of ink-drop generators, and the ink supply path is configured to supply the ink from the at least one ink-supply channel to the ink-supply chamber in a plane parallel with the bottom of the ink supply chamber.

2. The wafer structure according to claim 1, wherein the chip substrate is fabricated by the semiconductor process on a 12-inch wafer.

3. The wafer structure according to claim 1, wherein the chip substrate is fabricated by the semiconductor process on a 16-inch wafer.

4. The wafer structure according to claim 1, wherein the ink-supply chamber has the bottom in communication with the protective layer, and a top in communication with the nozzle.

5. The wafer structure according to claim 1, wherein the at least one inkjet chip further comprises a plurality of manifolds, wherein the at least one ink-supply channel is in communication with the plurality of the manifolds, and the plurality of manifolds are in communication with each of the ink-supply chambers of the ink-drop generators.

6. The wafer structure according to claim 5, wherein the number of the at least one ink-supply channel is one to six.

7. The wafer structure according to claim 6, wherein the number of the at least one ink-supply channel is one, thereby providing monochrome ink.

8. The wafer structure according to claim 6, wherein the number of the at least one ink-supply channel is four, thereby providing four-color ink of cyan, magenta, yellow and black, respectively.

9. The wafer structure according to claim 6, wherein the number of the at least one ink-supply channel is six, thereby providing six-color ink of black, cyan, magenta, yellow, light cyan and light magenta, respectively.

10. The wafer structure according to claim 1, wherein the conductive layer is connected to a conductor to form an inkjet control circuit.

11. The wafer structure according to claim 1, wherein the conductive layer is connected to a conductor, and the conductor is a gate of a metal oxide semiconductor field effect transistor.

12. The wafer structure according to claim 1, wherein the conductive layer is connected to a conductor, and the conductor is a gate of a complementary metal oxide semiconductor.

13. The wafer structure according to claim 1, wherein the conductive layer is connected to a conductor, and the conductor is a gate of an N-type metal oxide semiconductor.

14. The wafer structure according to claim 1, wherein the inkjet chip has a printing swath equal to or more than at least 0.25 inches, and the inkjet chip has a width ranging from at least 0.5 mm to 10 mm.

15. The wafer structure according to claim 14, wherein the printing swath of the inkjet chip ranges from 0.25 inches to 12 inches.

16. The wafer structure according to claim 14, wherein the printing swath of the inkjet chip is at least 12 inches.

17. The wafer structure according to claim 14, wherein the printing swath of the inkjet chip is 8.3 inches.

18. The wafer structure according to claim 14, wherein the printing swath of the inkjet chip is 11.7 inches.

19. The wafer structure according to claim 14, wherein the width of the inkjet chip ranges from 0.5 mm to 4 mm.

20. The wafer structure according to claim 14, wherein the width of the inkjet chip ranges from 4 mm to 10 mm.

* * * * *